United States Patent [19]

Strub

[11] 4,171,720

[45] Oct. 23, 1979

[54] MACHINE FOR PRODUCING FOUNDRY CORES

[75] Inventor: Jean P. Strub, Toul, France

[73] Assignee: Pont-A-Mousson S.A., Nancy, France

[21] Appl. No.: 882,469

[22] Filed: Mar. 1, 1978

[30] Foreign Application Priority Data

Mar. 2, 1977 [FR] France ..... 77 06082

[51] Int. Cl.[2] ..... B22C 15/24

[52] U.S. Cl. ..... 164/201; 164/202

[58] Field of Search ..... 164/19, 20, 21, 22, 164/201, 202, 200, 165, 166, 181

[56] References Cited

U.S. PATENT DOCUMENTS

| | | | |
|---|---|---|---|
| 3,756,342 | 9/1973 | Burdick | 180/125 |
| 3,989,086 | 11/1976 | Bührer | 164/201 |
| 4,031,946 | 6/1977 | Marti et al. | 164/89 |

FOREIGN PATENT DOCUMENTS

| | | | |
|---|---|---|---|
| 48-12608 | 4/1973 | Japan | 164/16 |
| 1258243 | 12/1971 | United Kingdom | 180/125 |
| 154370 | 10/1963 | U.S.S.R. | 164/202 |

*Primary Examiner*—Robert D. Baldwin
*Assistant Examiner*—K. Y. Lin
*Attorney, Agent, or Firm*—Sughrue, Rothwell, Mion, Zinn and Macpeak

[57] ABSTRACT

The machine comprises an openable moulding box which has a perforated top side and is in the form of two separable semi-moulds. A sand blowing head is movably connected to the machine stand by at least one pair of parallel connecting elements which form a deformable parallelogram structure. The head is capable of being moved away from the perforated top side or against the latter for blowing a mixture of sand and binder into the interior of the mould.

2 Claims, 21 Drawing Figures

MACHINE FOR PRODUCING FOUNDRY CORES

The present invention relates to a machine for producing foundry cores by a blowing of a mixture of sand and binder into a core box. It more particularly, but not exclusively, relates to the production of large cores.

Known machines of this type comprise an openable moulding box having a perforated side and formed by two semi-moulds and a blowing head carried by a stand and capable of being applied against and moved away from said perforated side.

In known machines of this type, the head is guided by slideways. Now, the sand blowing or "shooting" inevitably produces an escape of sand owing to wear and loss of sealing qualities between the blowing head and the core box. The machine is thus rapidly surrounded by sand which is obviously disadvantageous for the slideways guiding the blowing head and produces a premature wear by abrasion.

An object of the present invention is to overcome this drawback.

According to the invention, there is provided a machine of the aforementioned type, wherein the head is connected to the stand by at least one pair of parallel connecting elements forming a deformable parallelogram structure.

Thus, pivotal connections which are less sensitive to sand and dust replace slideways for guiding the blowing head. Preferably, the connecting elements are links pivoted at one end to the frame and at the other end to the head.

If the machine also comprises a carriage for supporting and discharging the core and advantageously movable on a horizontal track, this carriage is mounted on air cushion structures. The carriage is then devoid of any guiding slideway in the same way as the head. Moreover, the air cushions automatically sweep away the sand during the displacements of the carriage. It is then possible to employ other properties of air cushions if the carriage is shifted by a jack the body of which is pivoted by a ball joint and possibly if the runway is laterally defined by two ledges the spacing of which exceeds the width of the carriage; the carriage then has freedom of movement in all directions which greatly facilitates the centering of the semi-moulds.

Further features and advantages of the invention will be apparent from the ensuing description which is given solely by way of a non-limitative example with reference to the accompanying drawings in which.

Figure 1:
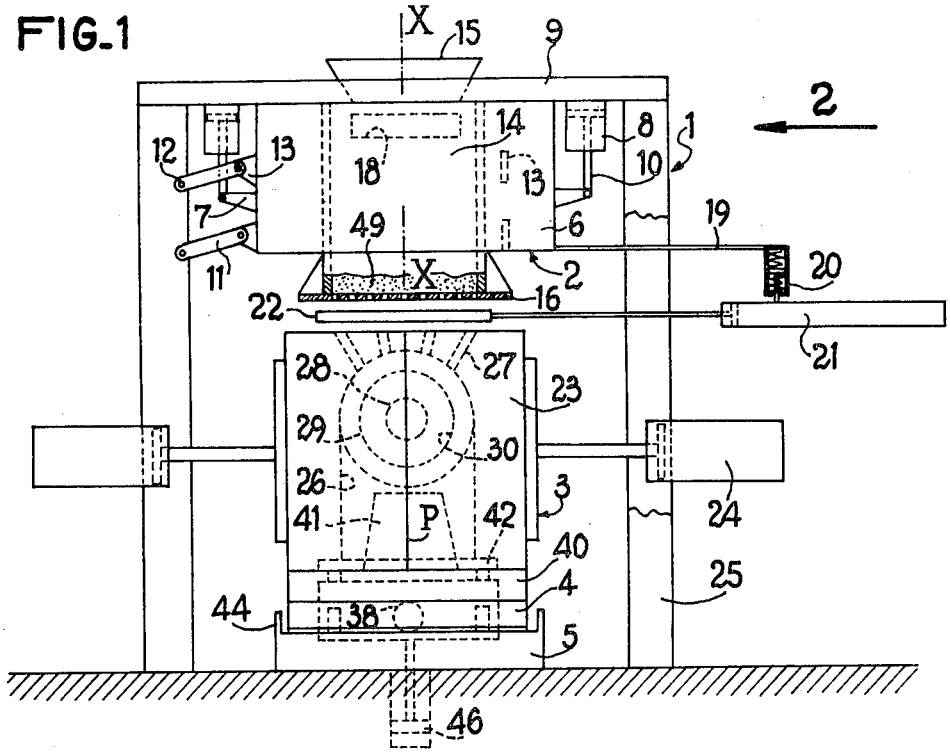
FIG. 1 is a diagrammatic assembly elevational view of a machine according to the invention, the core box being closed and empty and the blowing head ready for a blowing operation.
Figure 7:
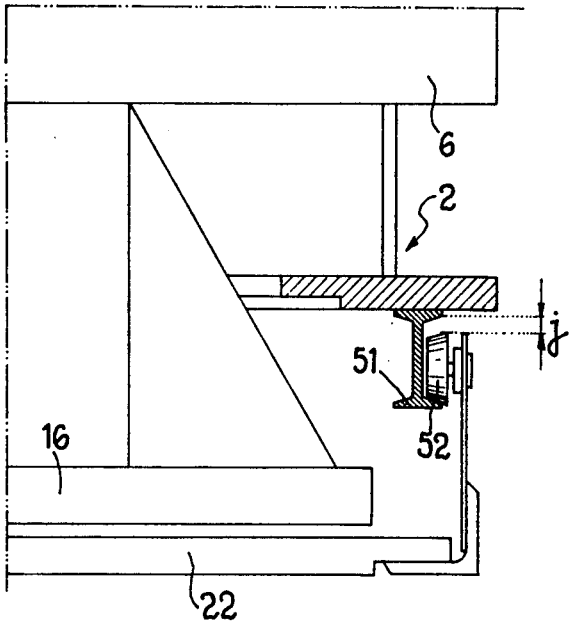

FIG. 7 is a partial diagrammatic view, to an enlarged scale, of a modification of the machine of FIGS. 1 and 2, and FIGS. 8 to 21 are diagrammatic views, to a reduced scale, of the machine in the different stages of a cycle for producing a core, FIGS. 8, 9, 12, 20 and 21 being views similar to FIG. 2, and FIGS. 10, 11, 13 to 17 and 19 views similar to FIG. 1.

Figure 2:
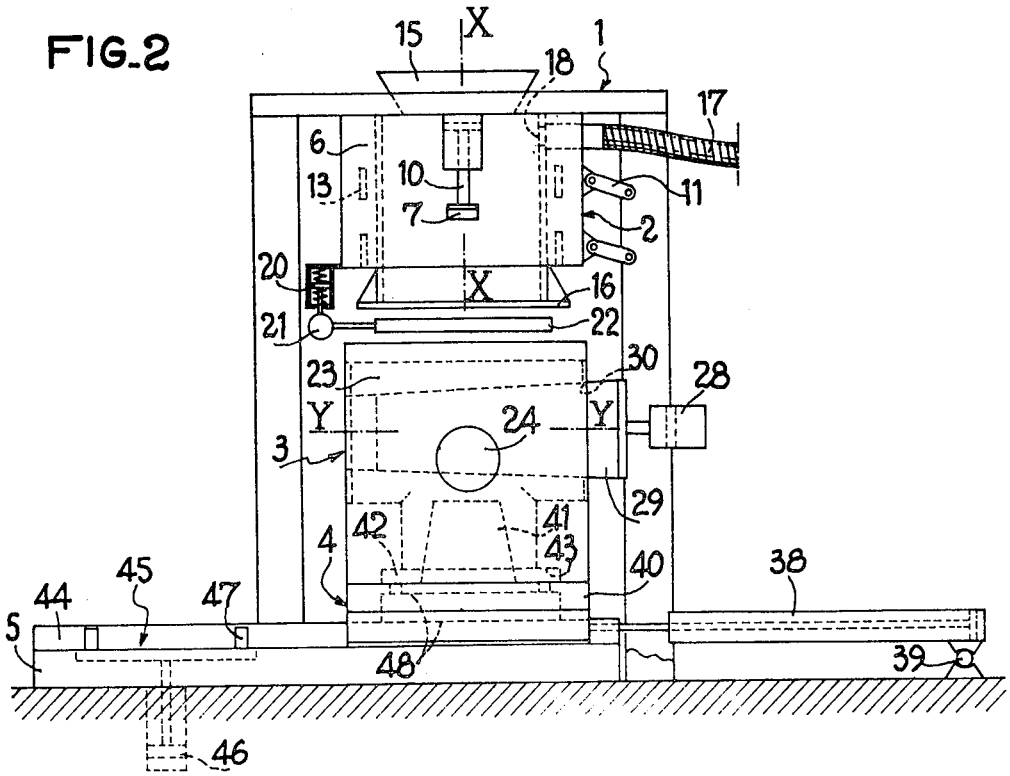
FIG. 2 is a corresponding side elevational view in the direction of arrow 2 of FIG. 1.

The machine shown in FIGS. 1 and 2 comprises a fixed stand 1 carrying a sand blowing or "shooting" head 2, an openable core box 3 having a parallel-sided shape and a carriage or support plate 4 movable along a runway 5.

The head 2 comprises a frame 6 provided laterally with a plurality of suspension lugs 7. Vertical jacks 8 extend downwardly from a horizontal girder 9 of the stand 1. The rod 10 of each of these jacks is pivoted to a lug 7 so that the frame 6 is suspended from the stand 1 and movable vertically or substantially vertically. The frame 6 is guided by means of at least one pair of parallel links 11 which have the same length and are pivoted, at one end, to two points 12 of the stand 1 in vertical alignment and, at the other end, to two ears 13 which are vertically spaced apart on one side of the frame 6 so that the four pivot points define a deformable parallelogram structure having two vertical sides. In the illustrated embodiment, three pairs of links 11 are provided on two vertical adjacent sides of the frame 6.

Fixed in the frame 6 is a tank or cylindrical sleeve 14 having a vertical axis and carrying at its upper end a supply hopper 15. The lower side of the tank 14 is formed by a horizontal perforated plate 16. The arrangement of the links 11 is such that, in the two extreme positions of the jacks 8, the plate has the same axis X—X. A flexible pipe 17 (FIG. 2) connected to a source of compressed air (not shown) communicates with the tank 14 by way of a lateral duct 18 of the latter.

A horizontal lateral arm 19 fixed to the frame 6 carries at its end, through an elastically yieldable suspension 20 having two coil springs, the horizontal body of a jack 21 whose rod supports a horizontal gasing mask 22 having the general shape of a horizontal plate. When the jack 21 is extended, the mask 22 is located under the plate 16. In the retracted position of the jack 21, this mask is located outside the path of the plate 16. The mask 22 is connected by a flexible pipe (not shown) to a gas generator (not shown) which is, for example, of the type described in French Pat. Nos. 2,155,781 and 2,199,484. The lower face of the mask 22 has the same perforations as the plates 16 and its upper side is solid, that is, unperforated.

The box 3 is formed by two identical semi-moulds 23 each carried by a horizontal jack 24 fixed to a post 25 of the stand 1. When the box 3 is closed, the two semi-moulds are joined along a vertical joint plane P containing the axis Y—Y and define a moulding cavity 26 having the shape of a core to be moulded. In the illustrated embodiment, it concerns a T-shaped core for manufacturing a tubular T-coupling.

Each semi-mould 23 has a number of passageways 27 putting its cavity in communication with its upper face. When the box 3 is closed, the outlet orifices of these passageways correspond with the perforations of the plate 16.

The semi-moulds 23 are guided in their movements by suitable conventional means (not shown) such as rollers rolling along support rails.

The stand 1 also carries a jack 28 perpendicular to the jacks 24 and carrying a conical mandrel 29 for lightening the core. When the box 3 is closed, the extension of this jack 28 causes the mandrel 29 to enter a circular opening 30 in this box on the axis Y—Y of the upper branch of the T of the moulding cavity which closes the latter and considerably reduces the space remaining free for receiving the material to be moulded.

Figure 6:
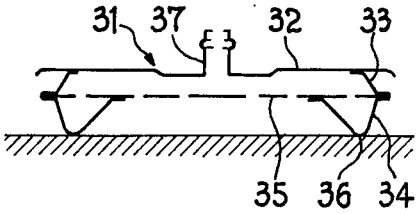
FIG. 6 is a diagrammatic sectional view of a carriage-supporting air cushion structure.

The carriage 4 comprises a rectangular plate in which are disposed, without projecting downwardly, a number of circular air cushion structures 31 (not seen in FIG. 1 but one of which is seen in FIG. 6). These air cushion structures comprise an upper support 32 and, under the latter, a suspension 33 and a skirt 34 which surround a perforated plate 35 between their edge portions. The skirt 34 defines a circular escape edge 36 and the air cushion structures communicate by way of a pipe 37 with a common source of compressed air (not shown). Such circular cushion structures are sold by the firm BERTIN & Cie. Fixed to one edge of the carriage 4 is the rod of a jack 38 whose body is pivoted by means of a ball joint 39 located on the axis of the track 5.

Disposed on the carriage 4 is a base plate or bed 40 carrying in its centre a vertical conical mandrel 41 for lightening the core. An annular core-carryng plate 42 is engageable on the mandrel 41 without clearance. This plate 42 also serves to position the semi-moulds 23 which are provided with a corresponding cavity 43 at their base. The axis of the mandrel 41 substantially coincides with the axis X—X when the jack 38 is retracted.

The track 5 is planar and horizontal and laterally defined by two vertical ledges or flanges 44 which are spaced apart a distance a little greater than the width of the carriage 4. This track 5 has, at the end opposed to the jack 38, and ejector 45 actuated by a vertical jack 46. When the jack 38 is extended, the carriage 4 is located above this ejector which can then pass through this carriage and the base plate 40 so as to urge the core-carrying plate 42 upwardly by vertical finger portions 47. Appropriate apertures 48 are of course formed for this purpose in the carriage 4 and the base plate 40.

All the considered jacks are double-acting jacks of known type operated by a fluid under pressure. They have been shown diagrammatically without their supply pipes or their control means. Likewise, the synchronizing devices obvious to one skilled in the art have not been described.

Figure 8:
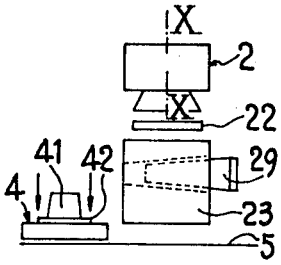

The machine just described operates in the following manner:

It will be assumed that a core has just been produced and discharged with its support plate 42 (FIG. 8). The carriage 4 carrying the bed 40 is located above the ejector 45 outside the stand 1. The core box 30 is open, the jack 28 supporting the horizontal mandrel 29 is retracted and the ejector 45 of the core has just withdrawn to the position of rest under the action of the jack 46. The cylinder 14 of the blowing head is filled with a mixture 49 of sand and binder which is, for example, a mixture in accordance with a formula of the American firm ASHLAND OIL comprising a binder based on polyisocyanate.

The gasing mask 22 is on the axis of the blowing head 2 between the latter and the box 3, but spaced from the box 3. The frame 6 of the head 2 is in the upper position.

Figure 9:
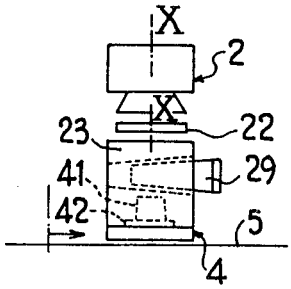
Figure 10:
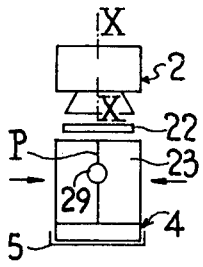

To start a new core-producing cycle, a new plate 42 is engaged on the mandrel 41 and the air cushion structures 31 are supplied with compressed air. The carriage 4 is then brought by the jack 38 on the axis X—X of the blowing head 2 and core box (FIG. 9). To displace the carriage along the track 5, it is slightly raised off the track 5 by the air cushion structures. This moreover serves to blow away the sand which is inevitably found on the track 5. The base plate or bed 40 is returned onto the axis of the blowing head.

The jacks 24 then urge the two semi-moulds 23 together which are joined on their joint plane P (FIG. 10) while they are centered by their cavities 43 on the plate 42 carried by the carriage 4 which is till resting on the air cushion structures. The supply of air to the carriage 4 is cut off. The carriage then descends into contact with the track 5 which has just been cleaned of its sand. This track then offers to the carriage 4, and consequently to the base plate 40, an excellent support surface.

Figure 11:
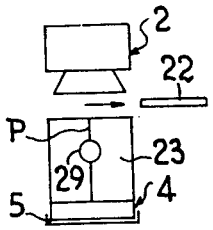

In order to permit the injection of sand into the box 3, the jack 21 withdraws the mask 22 away from the axis X—X of the machine and away from the path of the blowing head 2 (FIG. 11).

Figure 12:
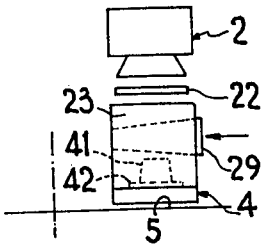

The jack 28 urges the mandrel 29 back into the core box 3 (FIG. 12).

Figure 3:
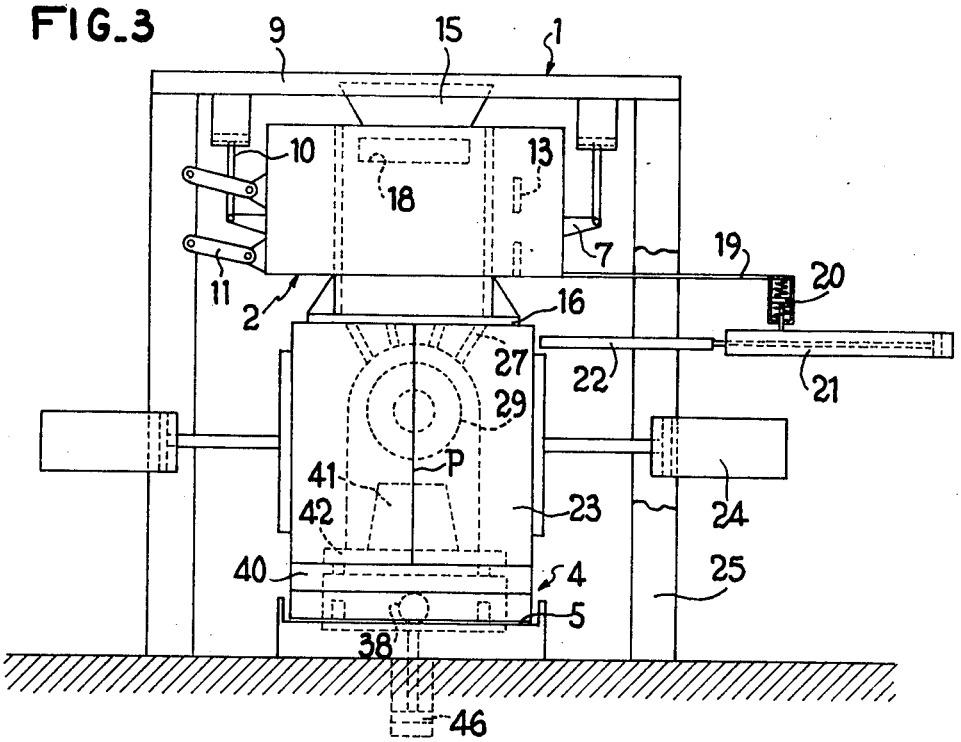
FIG. 3 is a diagrammatic view similar to FIG. 1 of the machine in the position for blowing, the blowing head being applied against the core box.
Figure 13:
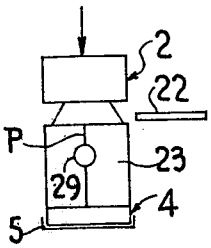

The vertical jacks 8 cause the frame 6 to descend which is guided by the pivotal links 11 forming an articulated parallelogram structure. The blowing head consequently descends until the perforated plate 16 is applied on the upper part of the box 3 against the orifices of the blowing passageways 27 (FIGS. 3 and 13). Note that the gasing mask 22 descends at the same time as the head 2 and the frame 6 with which it is made to move in translation by the arm 19 and the elastically-yieldable suspension head 2 is located exactly coaxial with the axis X—X so as to ensure a perfect correspondence of the blowing apertures of the plate 16 and box 3. Note that the links 11 describe an arc of a circle of very small amplitude so that the movement of the head 2 may be in practice likened to a rectilinear movement of translation. The compressed air is supplied by way of the pipe 17 and duct 18 to the interior of the cylindrical sleeve 14 of the head 2 above the mass of sand and binder 49. This mixture is then blown, "shot" or injected into the core box. By this rapid discharge of sand, the moulding cavity of the box is completely filled.

Figure 14:
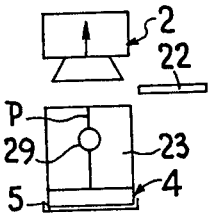
Figure 15:
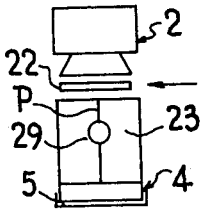

The jacks 8 raise the frame 6 of the head 2 and also the mask 22 and make way for the interposition of the mask 22 between the head 2 and the box 3 (FIG. 14).

The jack 21 shifts the gasing mask 22 and brings it onto the axis X—X of the head 2 above the box 3 for the following operation. This is the configuration shown in FIGS. 1, 2 and FIG. 15.

Figure 4:
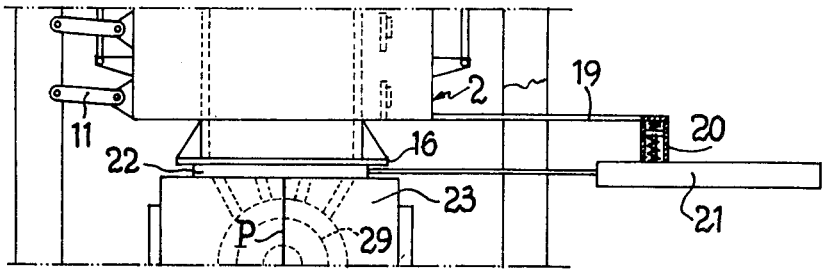
FIG. 4 is a partial view, corresponding to FIG. 1, of the machine in the gasing position for hardening the core.
Figure 16:
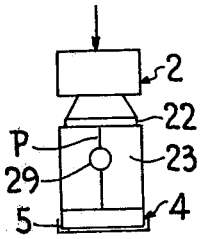

The jacks 8 again lower the frame 6 and the mask 22 until this mask is applied in a sealed manner by the plate 16 against the upper part of the box 3 by means of the arm 19 and the elastically-yieldable suspension 20 which is compressed. This is illustrated in FIGS. 4 and 16.

An amine-based gas capable of chemically reacting with the binder of the sand-binder mixture for the purpose of hardening the mixture is supplied through the mask 22 by the gas generator (not shown). The mask 22 distributes this gas through the blowing passageways 27 and the interior of the box 3 into the mass of the core 15 just moulded. The gas reacts chemically with the binder and hardens it. This operation for injecting gas and impregnating the core with this gas is followed, after stopping the supply of gas, by a scavenging operation by means of compressed air which is also supplied through the mask 22. This supply of air is then also stopped. The gas impregnation and the air scavenging last only a few moments (less than 1 minute).

Figure 17:
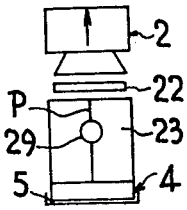
Figure 18:
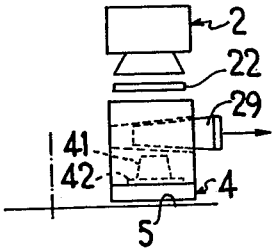

The jacks 8 raise the head 2 and the mask 22 through the arm 19 and the suspension 20 which is extended (FIG. 17).

The jack 28 withdraws the mandrel 29 which, owing to its frustoconical shape, easily comes away from the core 50. A slight disengagement of the mandrel 29 is sufficient with no need to withdraw it completely. This is why the travel of the jack 28 is short.

Figure 19:
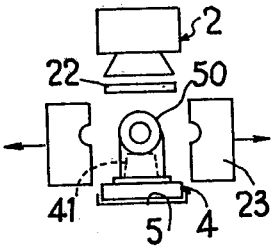

The jacks 24 separate the two parts 23 of the box 3 which disengage from the core 50 while the latter is still carried by the base plate 40 and centered on the vertical mandrel 41 (FIG. 19).

Figure 5:
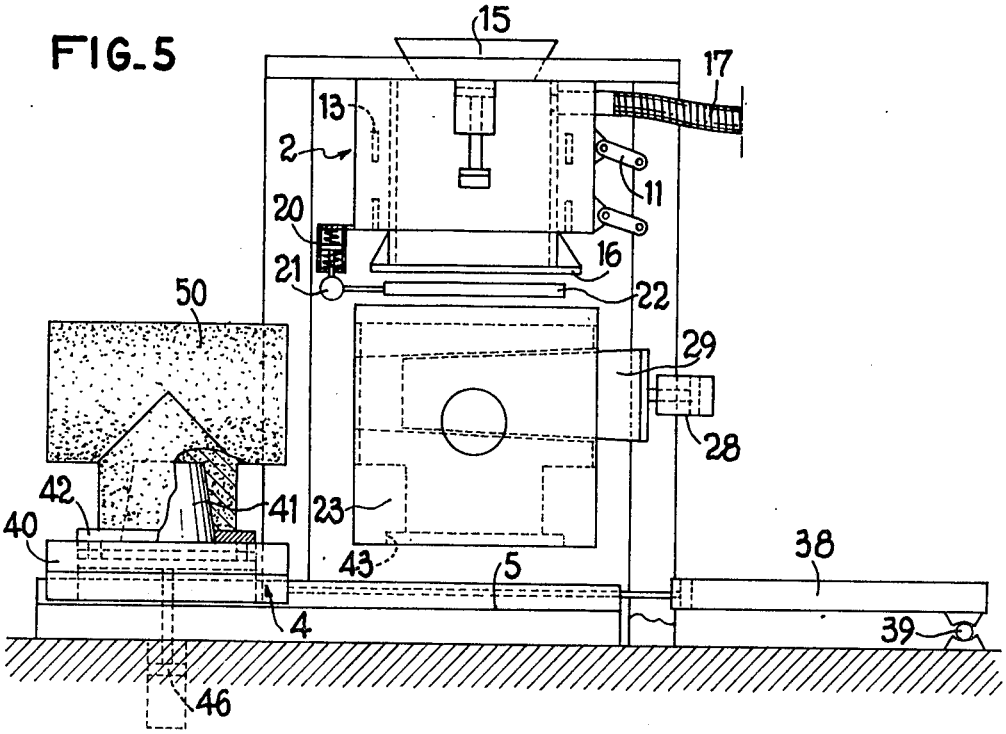
FIG. 5 is a diagrammatic view, similar to FIG. 2, of the machine after the opening of the core box and the extraction of the produced core.
Figure 20:
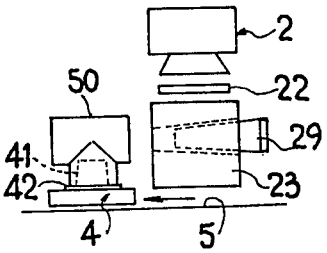

Compressed air is again supplied to the carriage 4 and the jack 38 urges this carriage, supported by the air cushions and carrying the base plate 40 and the core 50, along the track 5 away from the axis X—X. Note that the carriage 4 in travelling on air cushions, advantageously removes any trace of sand from the track 5. The carriage then reaches the ejecting station above the ejector 45 (FIGS. 5 and 20).

Figure 21:
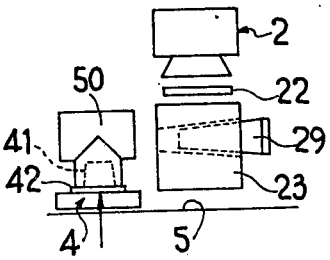

The jack 46 urges the ejector 45 upwardly (FIG. 21). The latter raises the plate 42 and the core 50 and disengages the core from the vertical mandrel 41. The core 50 is then discharged with the plate 42 by suitable means (not shown).

A core-producing cycle has just finished and the machine is ready for a new cycle.

By way of example, such a production cycle for large-size cores 50 of a volume of 150 liters in a parallel-sided box 3 having the dimensions 1 m×1 m×1.2 m, permits the production of 25 cores per hour, namely one core within 4/100 hour, that is to say, a little less than 2 minutes 30 seconds.

This machine has in particular the following advantages:

Owing to the grouped and compact construction of the blowing head, the different parts of the box 3 and the mask 22, and owing to the solely horizontal and vertical movements of all these parts, the displacements of the moving parts are as short as possible. Owing to the absence of, or minimum, friction, (pivoted links 11 and carriage 4 travelling on air cushions over the track 5), the displacements, are very rapid and the production rate is very high.

Owing to the pivoted links 11 forming an articulated parallelogram structure, the blowing head is perfectly guided with high precision in its upward and downward movements and its perforated plate 16 is always perfectly horizontal, particularly in the lower, blowing position. The pivotal movement of the links 11 advantageously replaces a movement of translation on slideways.

The use of air cushions interposed between the carriage 4 and the track 5 for shifting the base plate 40 carrying the vertical mandrel 41, obviously provides the advantage inherent in air cushions, namely the absence of friction, but also the following advantages particular to core-producing machies:

A perfect and very smooth centering of the central vertical mandrel 41 between the two semi-moulds 23 of the closed box 3 is achieved owing to the multi-directional mobility of the carriage 4 on the track 5 with interposition of air cushions, in combination with the pivotal connection of its actuating jack 38 on the ball joint 39. Indeed, when the two semi-moulds 23 are closed (FIG. 10), the centering bearing surface formed by the plate 42 is fitted in the corresponding bearing surface 43 of the two semi-moulds 23 with no difficulty of movement, since the track 5 on which the carriage 4 is wider than the latter and the carriage is supported on air cushions and the jack 38 can slightly pivot in different directions owing to the ball joint 39.

Furthermore, in the blowing position (FIG. 13), the carriage 4 bears directly on the track 5 without interposition of air cushions since the supply of air to the cushion structures is cut off. This give to the whole of the box 3 a good seating on a large area on the track 5 with a metal-to-metal contact which permits providing a high pressure of the sand-blowing compressed air through the pipe 17 and the duct 18 above the mass of sand 49 in the sleeve 14 and consequently inside the box 3 when injecting, the assembly of the blowing head 2 and the box 3 being held perfectly stationary.

Upon each displacement of the carriage 4 on the track 5, the air cushions interposed between the carriage and the track systematically sweep away the sand which has escaped and is inevitable in a sand-blowing machine for producing cores. Thus, neither the track 5 nor the lower face of the carriage 4 are liable to be worn by the abrasive character of the sand.

Notwithstanding the use of core sand, the powerful abrasive effect of which is known, the drawbacks of abrasion of the guide surfaces are avoided since there are no longer any slideways because they have been replaced, in respect of the head 3, by the pivotal link system 11, and, in respect of the carriage 4 which undergoes much larger displacements, by the air cushion system. This renders the machine according to the invention particularly reliable and permits reducing the maintenance or servicing of the guide means to a minimum while imparting high precision to the machine. Note in this respect that the links 11 are relatively remote from the region of projections of sand as they are positioned above the blowing plate 16.

By way of a modification, it will be understood that the invention is also applicable to the case where the core 30 has a silicate-based sand composition, for example sodium silicate, so that it may be hardened by carbon dioxide alone by means of the mask 22.

It is also applicable to the case where the core is of sand hardenable by the effect of heat, in which case the box 3 is a heating box and the mask 22 is eliminated.

The suspension 20–21 of the mask 22 may be replaced (FIG. 7) by a simple pair of parallel rails 51 (having an H-section) carried by the frame 6, and rollers 52 carried by the mask 22, a sufficient vertical clearance j being provided between the rollers and the flanges of the rails to allow the mask 22 to bear on the core box 3 when the frame 6 is lowered. The jack 21 connected to the stand 1 is then pivotally connected in an appropriate manner.

Also by way of modification, the links 11 may be replaced by parallel blade springs which are horizontal at rest and fixed at their ends to the stand 1 and the frame 6 of the head 2. The guiding parallelogram structures then have two vertical rectilinear sides and two other curvilinear sides.

Having now described my invention what I claim as new and desire to secure by Letters Patent is:

1. In a machine for blowing a foundry core made from a mixture comprising sand and a binder, the machine comprising a stand, an openable moulding box which has an upper perforated wall, a blowing head and having a lower perforated wall and located above the moulding box, means guiding the blowing head relative to the stand for movement of the head between a position in which the lower wall of the head is applied against said perforated upper wall of the box and the perforations of the lower wall of the head are in alignment with the perforations of the upper wall of the box and a position in which the lower wall of the head is spaced away from said perforated wall of the box; the improvement wherein the head guiding means comprise a deformable articulated parallelogram structure having two articulations pertaining to a side of the parallelogram structure which are mounted on the head and two articulations pertaining to an opposite side of the parallelogram structure which are mounted on the stand, and means interposed between the head and the stand for shifting the head between said two positions.

2. A machine as claimed in claim 1, wherein the articulated parallelogram structure comprises two parallel links, each link being pivoted adjacent one end of the link to the stand and adjacent an opposite end of the link to the head.

* * * * *